US006049990A

United States Patent [19]

Holland

[11] Patent Number: 6,049,990

[45] Date of Patent: Apr. 18, 2000

[54] MULTIFUNCTION LAYOUT TOOL

[76] Inventor: Lewis G. Holland, 20701 Holland La., Roland, Ark. 72135

[21] Appl. No.: 08/994,244

[22] Filed: Dec. 19, 1997

[51] Int. Cl.[7] ..... B43L 7/10

[52] U.S. Cl. ..... 33/464; 33/465; 33/468; 33/469; 33/470; 33/471; 33/472

[58] Field of Search ..... 33/464, 465, 468, 33/469, 470, 471, 472, 473

[56] References Cited

U.S. PATENT DOCUMENTS

| | | | |
|---|---|---|---|
| 905,249 | 12/1908 | Townsend | 33/464 |
| 964,785 | 7/1910 | Johnson | 33/464 |
| 2,582,649 | 1/1952 | Olson | 33/464 |
| 3,273,246 | 9/1966 | Siberini | 33/464 |
| 3,324,559 | 6/1967 | Williamson | 33/464 |
| 4,599,806 | 7/1986 | Wright | 33/469 |
| 5,832,618 | 11/1998 | Scarborough | 33/451 |
| 5,915,806 | 6/1999 | Levee | 33/42 |
| 5,983,509 | 11/1999 | Gosselin | 33/424 |

*Primary Examiner*—Randy W. Gibson
*Attorney, Agent, or Firm*—Jerry L. Mahurin

[57] ABSTRACT

A Multifunction Layout Tool capable of performing the functions of an adjustable square, adjustable T-square, try square, combination square, protractor, angle duplicator, depth gauge, rip gauge, rafter-stair layout tool, and compass is disclosed. The tool comprises a generally T-shaped squaring base, mounting an elongated sliding rule. The base is comprised of a body defining a central flared channel to receive the rule and a pair of squaring arms extending from the body, defining a squaring edge along an end of the base, perpendicular to the channel. The rule is disposed in and extends out of the channel, between the squaring arms. The rule is a blade having a rounded end, a square end, and a central longitudinal slot. A fastener anchored to the base, extending through the rule slot, maintains the rule within the channel. Protractor indicia disposed within the channel and corresponding vernier indicia on the rounded end of the rule measure disposition angles of the rule when the rule is fully extended. Direct reading intermediate angle indicia, comprising paired parallel lines can be disposed within the flared portion of the channel. Direct measurement indicia along the blade initiates from the square end of the blade; and radius measurement indicia for drawing a circle of a given radius, measured from the squaring edge of the base, initiates from the distal end of the blade slot. Alternatively, a vial level may be disposed generally parallel with the squaring edge, in a recess defined in the back of the base.

20 Claims, 11 Drawing Sheets

162
147
80
160
155
87
150
30
37
20
145
140
37
60
45
40
165
75
55
45
55
39
38
25
73
70
120
85
115
135
100
125
110
130
139
137
65
35
65

MULTIFUNCTION LAYOUT TOOL

BACKGROUND OF THE INVENTION

The present invention broadly relates to squares, protractors and other geometric layout instruments and tools. Specifically, the present invention is a Multifunction Layout Tool which is capable of performing the functions of an adjustable square, adjustable T-square, a try square, a combination square, a protractor, an angle duplicator, a depth gauge, a rip gauge, a rafter-stair layout tool, and a compass. Art pertinent to the subject matter of the present invention can be found in United States Patent Class 33, Subclasses 418 through 426, particularly subclasses 418, 419 and 424 through 426.

Innumerable patents have been issued on geometrical instruments, particularly those intended to aid in the layout of construction and building materials such as lumber, metal or steel. Most of these prior art patents deal with squares, protractors, combination squares and the like.

Special tools to deal with pipe and other cylindrical surfaces are fairly common. Yavicoli, U.S. Pat. No. 1,893,973, discloses a squaring tool with two protruding arms at a 45° angle. A ruler used in conjunction with this device is used to mark lines or cords across cylindrical objects. Howard, U.S. Pat. No. 4,914,825 is one of many patented pipe fitting related squaring tools. This patent is typical of such tools. This particular tool employs two 45° arms.

Specially designed tools are also common in the art. Bear, U.S. Pat. No. 5,349,758 discloses a multi-use wood-working square. This device has a pivot point which can be centered or located against the edge of wood to assist in drawing circles or arcs. McCormick, U.S. Pat. No. 981,867, discloses something akin to a "speed" square with a pair of pivoted blades pivoted to the top corner of the square.

Various types of combination squares and modifications to combination squares are present in the art as well. Evans, U.S. Pat. No. 389,370, discloses a bevel square which has a set of fixed angles, particularly 45°. Rakauskas, U.S. Pat. No. 5,276,973, discloses a combination square which has been modified with a second slider to serve as a height and/or width gage. A combination square with a centering head is disclosed in Rowell, U.S. Pat. No. 535,223.

Various folding rules and the like are disclosed in the following patents. Van Gale, U.S. Pat. No. 1,630,773 discloses a folding rule adapted to be used as a set of dividers and/or a compass. Phillips, U.S. Pat. No. 263,351 discloses a yardstick which folds out to a predetermined angle for marking fabric "on the bias".

A protractor with a squaring base and pivoting blade is disclosed in Gilcrest, U.S. Pat. No. 591,964. Will, U.S. Pat. No. 1,613,776, discloses a protractor type device with a squaring base. Elder, U.S. Pat. No. 1,773,809 discloses a protractor which has a straightedge extending therefrom for laying out and/or plotting various line configurations. Liu, U.S. Pat. No. 4,535,542, discloses a 360° protractor with a vernier scale and a pair of sliding straightedges.

Modifications to T-squares to allow them to produce angled lines are quite common. Bronson, U.S. Pat. No. 58,056, discloses a T-square with a protractor head having a pivoting squaring base associated with the protractor. Salot, U.S. Pat. No. 227,844, discloses a T-square having a protractor deployed in combination with the T-square head. Davis, U.S. Pat. No. 1,381,808, discloses an T-square with a pivoting blade, indexing holes at particular angles and a protractor scale across the top of the base. Morris, U.S. Pat. No. 2,423,786, discloses a drafting tool which has a T-square component with a protractor superimposed over the base and a second straightedge pivoted in conjunction with the protractor portion of the device. Dillemuth, U.S. Pat. No. 3,103,749 discloses a square having a head somewhat similar to the frame body of a conventional level with a gear tooth appendage extending therefrom. The appendage can be deployed at various angles.

Multiple straightedges, protractors and the like are combined together to create angle drawing tools in several patents. Terenzoni, U.S. Pat. No. 5,446,969 discloses a square which has a longitudinal slot along one leg of a somewhat conventional framing square. The framing square has a flat, perpendicular edge for helping to square the device. Hopfer, U.S. Pat. No. 4,697,351 discloses a layout square employing a combination square type device and two other locking sliding mechanisms to facilitate drawing angled lines and/or parallel lines or lines parallel to an edge. Some angle drawing tools are extremely complicated. Rohde, U.S. Pat. No. 4,352,247, and Milla, U.S. Pat. No. 1,999,105, disclose rather elaborate square, angle and protractor setups for drawing angled and parallel lines.

Modifications to framing squares and bevels to facilitate drawing angled lines are also common. Hurt, U.S. Pat. No. 4,348,815, and Baumunk, U.S. Pat. No. 2,775,037, disclose adjustable squares with indexing pins for particular angles. Hill, U.S. Pat. No. 304,196, discloses a bevel with a spring loaded detent blade lock. Clark, U.S. Pat. No. 899,692; and Rizianu, U.S. Pat. No. 1,916,638; disclose reinforced bevels with angle indicia on one or both blades. Several Patents including Moore, U.S. Pat. No. 596,818; Hill, U.S. Pat. No. 3,345; Siggson, U.S. Pat. No. 2,656,609; and Dvorak, U.S. Pat. No. 1,210,370; disclose elaborate bevels employing sets of level bubble tubes. Welch, U.S. Pat. No. 4,955,141, discloses an adjustable pivot square somewhat similar to a reinforced or stabilized level.

Schaller, U.S. Pat. No. 714,404, discloses a T-square type device. King (Edward), U.S. Pat. No. 1,525,813, teaches the use of an orifice at each end of a combination square's straightedge to allow the straightedge to pivot about the square's base. Andrews, U.S. Pat. No. 3,510,950, discloses a combination square which employs pins to dispose the straightedge at different fixed angles. Two patents issued to Calvin King, U.S. Pat. Nos., 4,736,524 and 3,828,436, disclose devices employing a squaring head which has a protractor deployed in conjunction with the head and a straightedge extending from the protractor. The later patent, U.S. Pat. No. 4,736,524, uses a vernier type scaled for angle matching. A carpenters square and protractor is disclosed in Wright, U.S. Pat. No. 4,599,806. This device is basically a combination T-square, similar to a draftsman's T-square and protractor. The T-square employs a rotating blade which can be placed at a desired angle. Miller, U.S. Pat. No. 4,702,012, discloses a multi-part tool having a head with a squaring face and fixed positions for a sliding rule at 90° and 45° to either side. The device also mounts a tape measure.

Hence, it is desirous to provide a simple to use Multifunction Layout Tool capable of carrying out the functions of several conventional layout tools in a single unit. Additionally, such a tool should be relatively compact and sturdy to standup to the practical requirements of the work place whether it be a shop, worksite or around the home.

SUMMARY OF THE INVENTION

My invention is a Multifunction Layout Tool which combines the functions of an adjustable square, adjustable T-square, a try square, a combination square, a protractor, an angle transfer tool, a compass, a depth gauge and a rip gauge in a single, easy to use, sturdy, compact unit.

My layout tool is comprised of a base with a slotted rule slideably held in a channel defied in the base using a quick release fastener. The fastener comprises a stud and nut arrangement, or a thumb screw threaded into the base. The fastener extends through the slot in the rule to maintain the rule in the channel.

A portion of the open faced channel in the base has a width approximately equal to the width for the rule to prevent side to side movement of the rule. Near a squaring edge defined by the base, the channel flares outward to either side at forty-five degree angles. The walls of the flared portion of the channel function as stops for the rule when it is rotated around the fastener.

Squaring flanges extend outwardly from the squaring edge to aid squaring the tool along a straight edge of building material or the like. A V-shaped index notch is defined between the flanges, in the center of the squaring edge. The squaring edge and flanges are disposed perpendicular to the rule when it is disposed in the first portion of the channel. A vial level is disposed in a recess on the back of the base adjacent the squaring edge.

The rule has a square end and a radiused end. The ends of the slot are rounded to allow rotation of the rule about the fastener, and to facilitate rotation of the entire tool about a pencil or the like positioned in the slot to draw a circle of a given radius at the V-shaped notch.

Indicia disposed within the channel and on the rule are used for measurement and to set up the tool for use. A protractor scale disposed in the channel is aligned with a vernier scale disposed on the radiused end of the rule to measure and layout angles in one degree increments relative to the squaring edge of the base. Preferably, the radiused end of the rule is bevel to facilitated aligning the vernier and protractor markings.

Linear measurement indicia is also disposed on the rule. A direct measurement linear scale is disposed along one edge of the rule while a diameter scale for drawing circles and arcs is disposed on the opposite edge. The distal end of the rule has a set of marks with a central mark aligned with the centerline of the rule.

Paired parallel intermediate angle marks are disposed in the flared portion of the channel for ready alignment of the ruler at one or more often used angles.

To act as a square, gauge or compass the rule is retracted to be retained at least partially between the parallel side walls of the channel, or the rule's vernier and the protractor are zeroed.

To layout or measure angles the rule is fully extended so that the end of the rule slot pivots on the fastener between the sides of the flared portion of the channel. The edges of the rule are aligned with the paired predetermined angle lines defined in the flared portion of the channel; and/or, the vernier and protractor are aligned at the desired angle relative to the squaring edge of the base.

Therefore, a primary object of the present invention is to provide a multifunction layout tool.

More specifically, an object of my layout tool is to provide a the functions of several types of layout instruments in a single instrument.

An object of the present invention is to provide a layout tool capable of acting as an adjustable square or adjustable T-square.

An object of the present invention is to provide a layout tool capable of acting as a try square.

An object of the present invention is to provide a layout tool capable of acting as a combination square.

An object of the present invention is to provide a layout tool capable of acting as a protractor and angle transfer tool.

An object of the present invention is to provide a layout tool capable of acting as a depth gauge.

An object of the present invention is to provide a layout tool capable of acting as a rip gauge.

An object of the present invention is to provide a layout tool capable of acting as a level.

An object of the present invention is to provide a layout tool capable of acting as a compass to draw circles.

More particularly an object of the present invention is to provide a single tool capable of duplicating and/or combining the functions of an adjustable square, adjustable T-square, a try square, a combination square, a protractor, an angle transfer tool, a compass, a depth gauge and a rip gauge.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
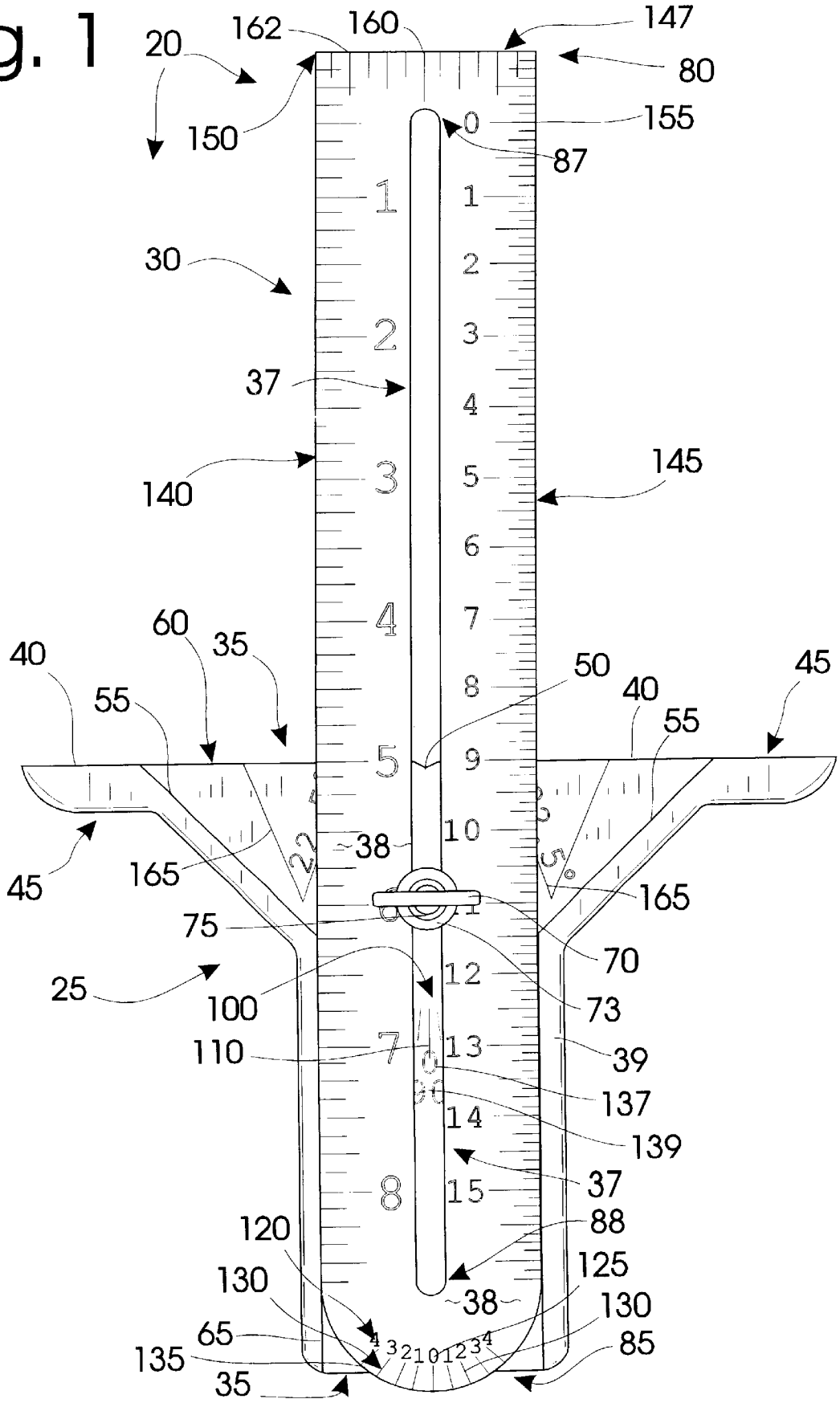
FIG. 1 is a top plan view of my Multifunction Layout Tool with the rule partially retracted into a suitable arrangement to be used as a square, compass, rip gauge or depth gauge.
Figure 2:
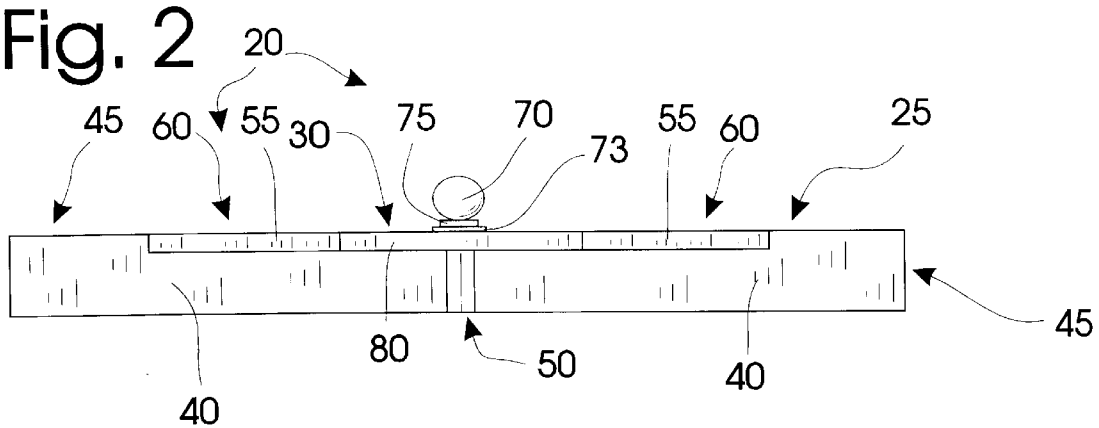
FIG. 2 is a front elevational view of my layout tool.
Figure 3:
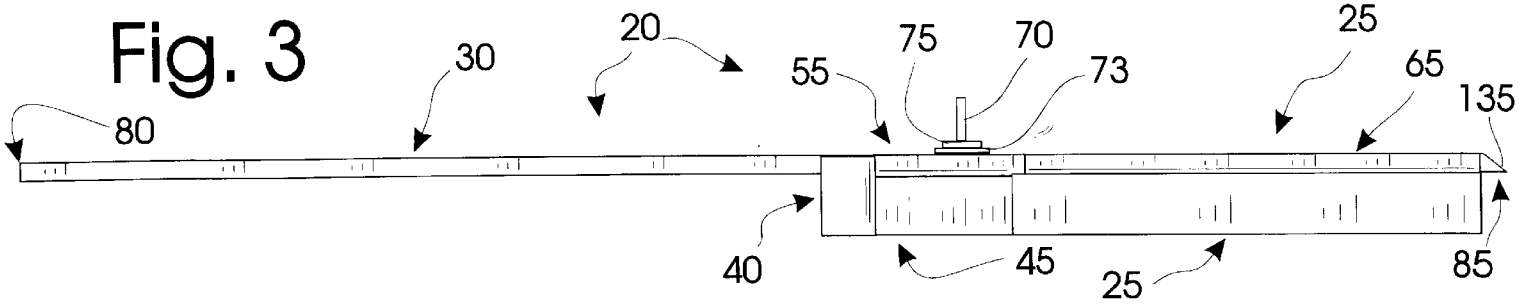
FIG. 3 is a side elevational view of my layout tool.
Figure 4:
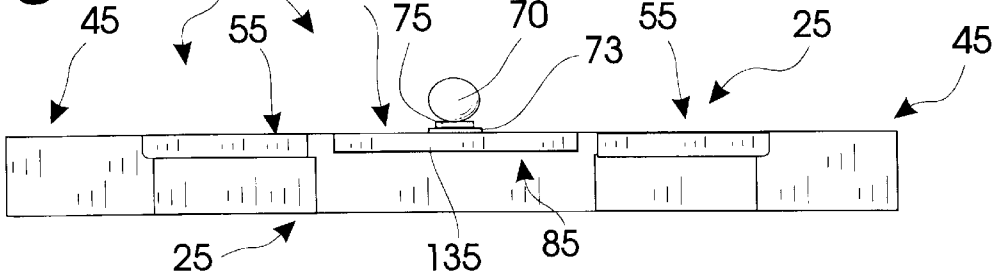
FIG. 4 is a rear elevational view of my layout tool.
Figure 5:
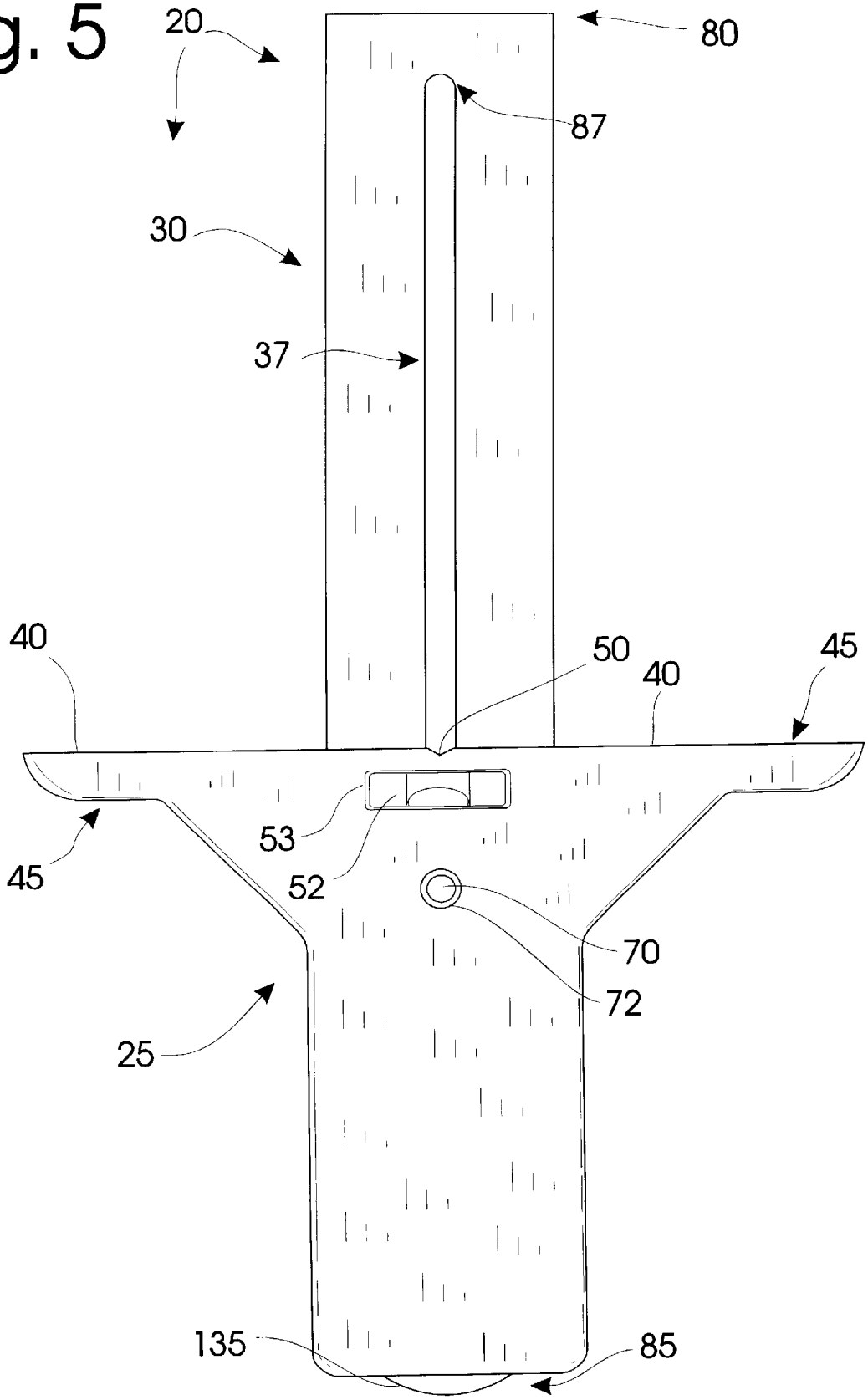
FIG. 5 is bottom plan view of my tool.
Figure 6:
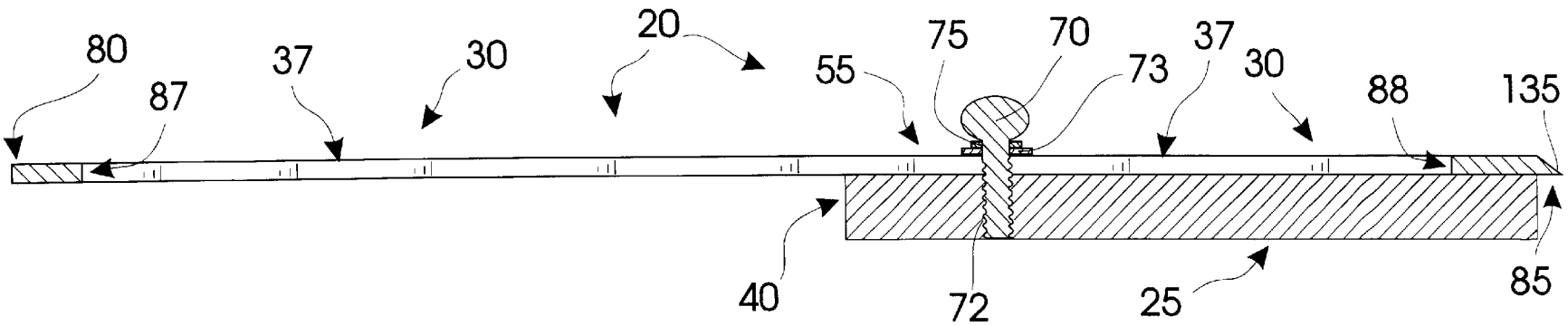
FIG. 6 is a fragmentary side view of my layout tool, illustrating the relationship of the rule, base and fastener.

With reference now to the accompanying drawings, the preferred embodiment of my Multifunction Layout Tool is broadly designated by the reference numeral 20. My layout tool 20 is comprised of a base 25 with a slotted blade rule 30 disposed within a channel 35 defied in the base 25. A relatively quick release fastener is anchored to the base 25 and extends through the slot 37 in the rule 30 to maintain the rule 30 in position within the channel 35.

The base 25 is used as a handle to manipulate the tool 20. The base 25 defines an open faced channel 35 to receive the rule 30. The channel 35 has a depth approximately equal to the thickness of the rule 30 and a width approximately equal to the width for the rule 30. Therefore, the face 38 of the rule 30 is generally flush with the face 39 of the base 25, when the rule 30 is disposed within the channel 35. Furthermore, it is restrained, preventing side to side movement.

The base 25 also comprises a squaring edge 40. A pair of flanges 45 extend outwardly from the base 25 to facilitate squaring of the tool 20 along a straight edge 47 of lumber 49 or the like. The squaring edge 40 and flanges 45 are disposed perpendicular to the length of the channel 35 and thereby to the rule 30 when it is disposed within the channel 35. A V-shaped index notch 50 is preferably defined in the squaring edge 40, aligned with the centerline of the channel 35 and perpendicular to the channel's longitudinal axis. A vial type bubble level 52 is disposed in a recess 53 on the back of the base 25 adjacent the squaring edge 40. The level 52 facilitates the use of the tool 20 as a horizontal level and vertical plumbing tool when the squaring edge 40 is placed along the edge of a workpiece 49.

The channel 35 flares outward near the squaring edge 40. The side walls 55 of the flared portion 60 of the channel 35 are disposed at a forty-five degree angle to the parallel main channel walls 65. The flared walls 55 act a stop for the rule 30, facilitating deposition of the rule 30 at a forty-five degree angle relative to the squaring edge 40 and flanges 45.

To maintain the rule 30 within the channel 35, a thumb screw 70 is received by a threaded orifice 72 defined in the flared portion 60 of the channel 35, in line with the center of the channel 35. The thumb screw 70 indexes with the longitudinal slot 37 defined in the rule 30. The thumb screw 70 preferably mounts a washer 73 and/or defines a shoulder 75 to aid in bearing on the rule 30. Alternatively, a stud extends upward from the channel 35 to index with the longitudinal slot 37 defined in the rule 30 in place of the threaded orifice 72 and thumb screw 70 arrangement. The stud receives a washer and wing nut or a similar easy to release fastener. The threaded orifice 72 or (stud) is disposed within the flared portion 60 of the channel 35 to facilitate rotation of the rule 30 when fully extended.

The rule 30 is a slotted blade having a square distal end 80 and a radiused proximal end 85. The rule 30 is slideably disposed within the channel 35 of the base 25. The thumb screw 70 or the stud with the wing nut extends through the longitudinal slot 37 defined in the rule 30. This arrangement holds the rule 30 in place in the channel 35 while allowing it to be slid through the channel 35 for necessary adjustment of the rule's protrusion beyond the base 25. The ends 87 and 88 of the slot 37 are rounded. The proximal end 88 of the slot 37, adjacent the radiused end 85 of the rule 30, is positioned and rounded to allow rotation of the rule 30 about the thumb screw 70 or stud. The distal end 87 of the slot 37, adjacent the square end 80 of the rule 30, is rounded to facilitate use of a pencil 90 or the like positioned in the slot 37 to draw a circle or arc 152 of a given radius by rotating the entire tool 20 about a punch, pencil 90 or the like anchoring the tool 20 at the V-shaped index notch 50. Preferably the rule 30 has a width approximately that of standardized dimensional lumber, which would most practically be one and one-half inches in the United States.

Several groups of indicia are disposed within the channel 35 and on the rule 30. A protractor scale 100 is disposed within the parallel portion of the channel 35, adjacent the threaded orifice 72 or mounting stud. This protractor scale 100 preferably marks degrees of measurement in five degree increments from a zero 110 in the centerline of the channel up to forty-five degrees 115 on either side. A corresponding vernier scale 120 on the radiused end 85 of the rule 30 indexes with the channel's protractor scale 100. The vernier scale 120 also has a centerline zero 125. However, the four vernier marks 130 are spaced eleven degrees apart. As a result the vernier marks 130 act in conjunction with the protractor scale 100 disposed in the channel 35 to provide alignment readings of the rule's disposition in one degree increments relative to the squaring edge 40 of the base 25. Preferably, the edge 135 of the radiused end 85 of the rule 30 is bevel to accommodate alignment of the vernier and protractor markings 120 and 100. The protractor scale is preferably marked with two scales 137 and 139. An inner scale 137 indicates direct measurement of the rule's (acute) angle while an outer scale 139 allows measurement of reverse or obtuse angles.

Also disposed on the rule 30 are linear measurement indicia 140, 145 and 147. Along one longitudinal edge of the rule 30 is a direct measurement linear scale 140 facilitating use of the tool 20 as a rip or depth gauge when the rule 30 is partially retracted. (See FIGS. 1, 11 and 12.) Therefore, the zero point 150 for this scale is at the distal 80 end of the rule 30. Along the opposite edge is a diameter scale 145 for drawing circles and arcs 152. (see FIG. 13). This scale 145 has a zero origin 155 aligned with the distal rounded end 87 of the slot 37. The diameter scale 145 is in one-half measurement increments to facilitate drawing a circle or arc 152 having a particular diameter. Finally, the distal end 80 of the rule 30 has a set of direct measuring marks 147 a zeroing or center mark 160 is disposed aligned with the centerline of the rule 30 and fractional measurement marks 162 are disposed therefrom.

Other indicia 165 preferably disposed in the channel 35 comprise paired parallel intermediate angle indicating lines 165 disposed in the flared portion 60 of the channel. For example as illustrated, twenty-two and a half degree lines 165 can be used for ready alignment of the rule 30 at an often used angle. See FIG. 8.

OPERATION

In operation the present tool 20 can duplicate and/or combine the functions of an adjustable square, adjustable T-square, a try square, a combination square, a protractor, an angle transfer tool, a compass, a depth gauge, a rip gauge and a level.

To act as a square, gauge or compass the rule 30 is preferably retracted to be retained at least partially between the parallel side walls 65 of the channel 35, as illustrated in FIG. 1. Alternatively, the zero 130 of the rule's vernier scale 120 can be aligned with the zero 110 of the protractor scale 100 disposed in the channel 35, thereby, orienting the rule 30 at a right angle to the squaring edge 40 of the base 25. When the rule 30 is aligned perpendicular to the squaring edge 40, the tool 20 can be uses as one would use a T-square, a try square or the square portion of a combination square. The rule 30 can be retracted in tight situations and extended as necessary to facilitate use as a square.

Figure 11:
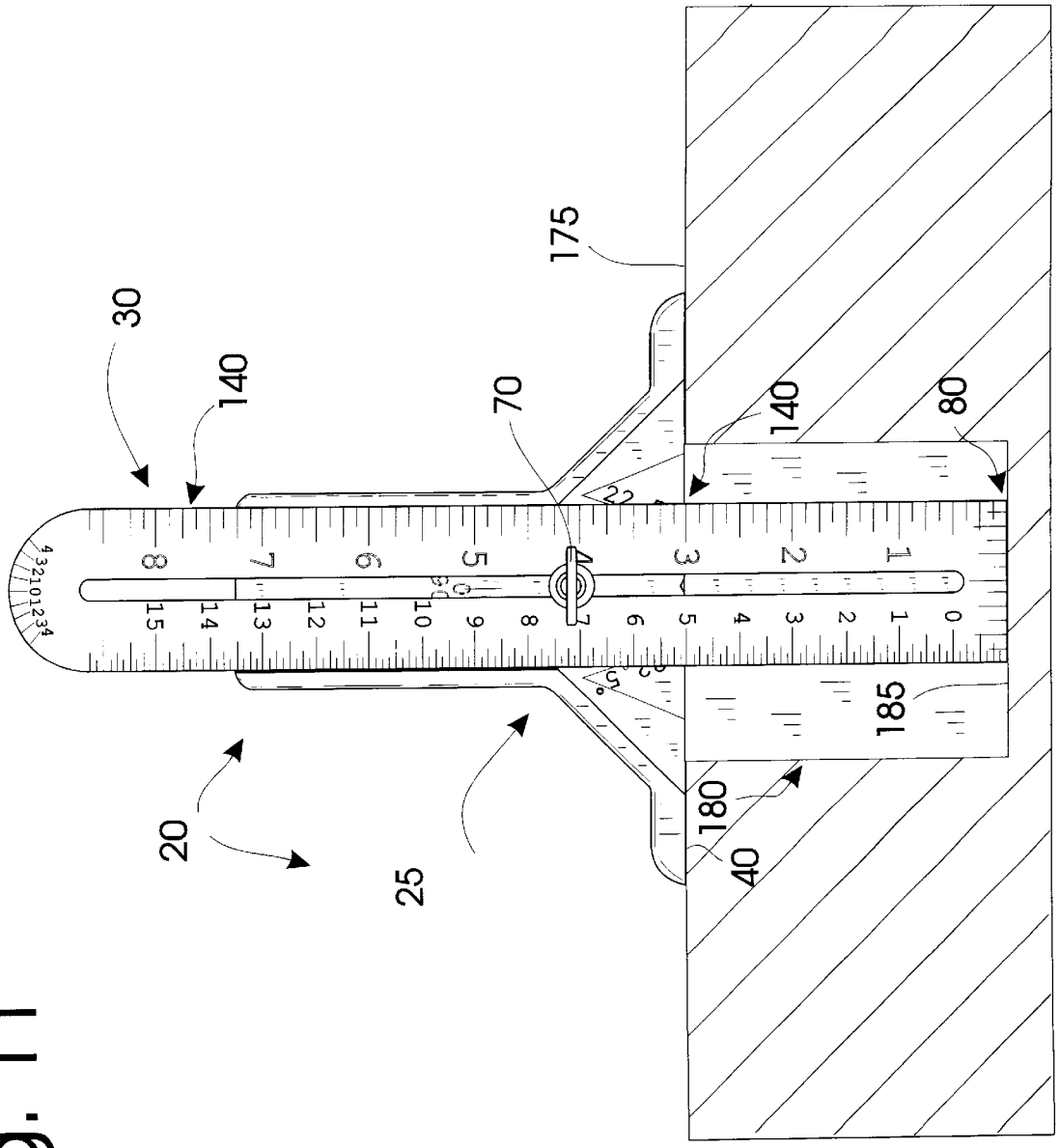
FIG. 11 is an environmental view of my tool in use as a depth gauge.

The direct measurement indicia on the rule 30 can be used in conjunction with the squaring configuration described above to accurately measure depths and to mark rip lines 190 on material 49. FIG. 11 illustrates use of the tool 20 as a depth gauge. The squaring edge 40 of the base 25 can be abutted to the top 175 of an opening 180 and the rule 30 freed to extend down into the opening 180 to the bottom 185. Once the distal end of the rule 80 bottoms out, the rule 30 is locked in place by tightening the thumb screw 70 or nut, and the tool 20 is withdrawn for reading. The depth measurement can be taken on the rule's direct reading scale 140 at the intersection of the rule 30 and the squaring edge 40 of the base 25.

Figure 12:
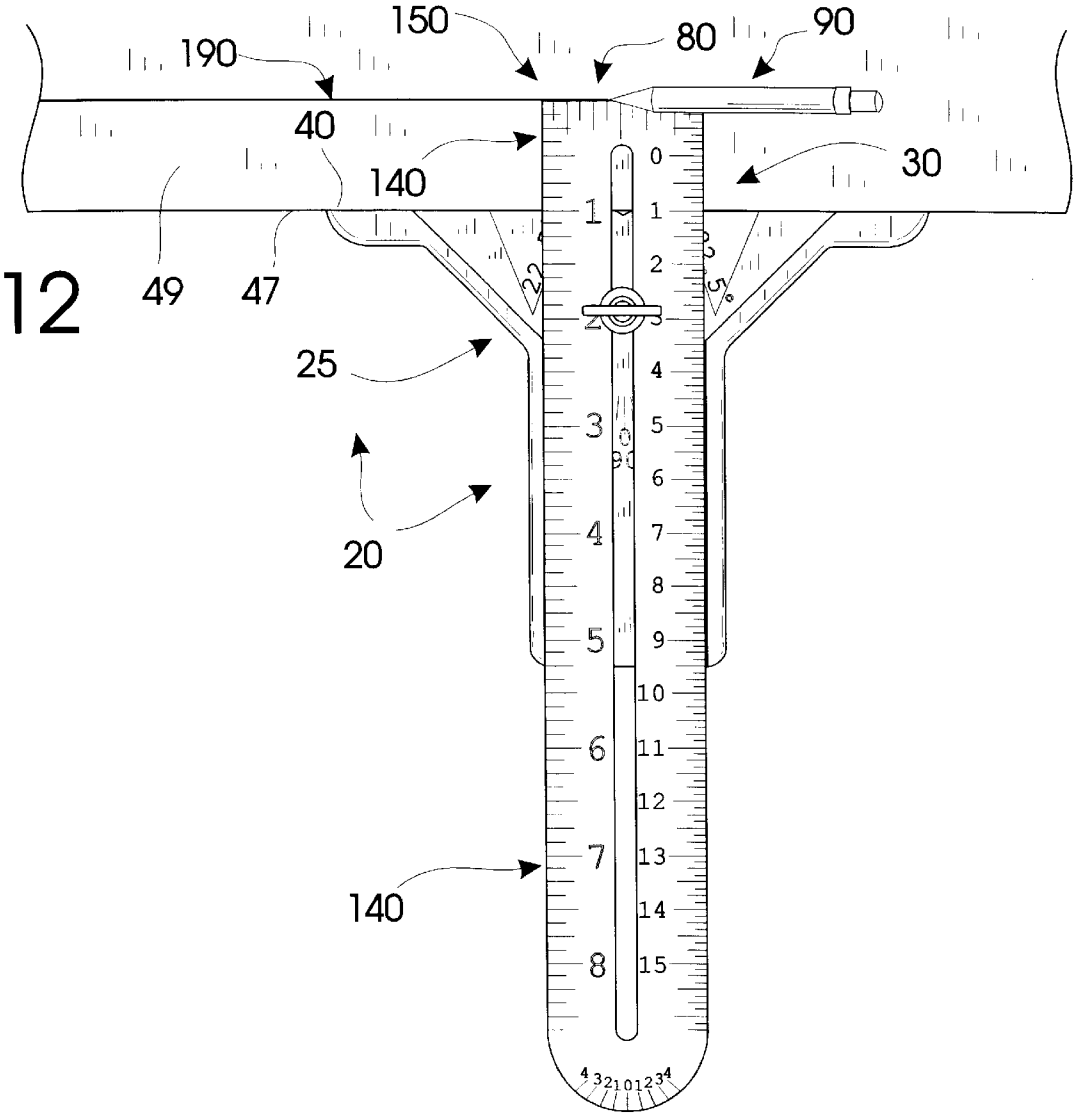
FIG. 12 is an environmental view of my tool in use as a rip gauge.

A measurement can be set at the intersection of the squaring base 25 and the direct reading scale 140 to provide rip markings 190 on material 49 as illustrated in FIG. 12. A rip mark 190 is made by holding a pencil 90 of the like against the distal end 80 of the rule 30 while sliding the squaring edge 40 of the base 25 along the edge 47 of the material 49.

By laying the tool 20 on a work surface and using the zero end 150 of the rule 30 and the intersection of the rule 30 and squaring edge 40 the function of a set of dividers can be duplicated with the advantage of direct reading measurements.

Figure 13:
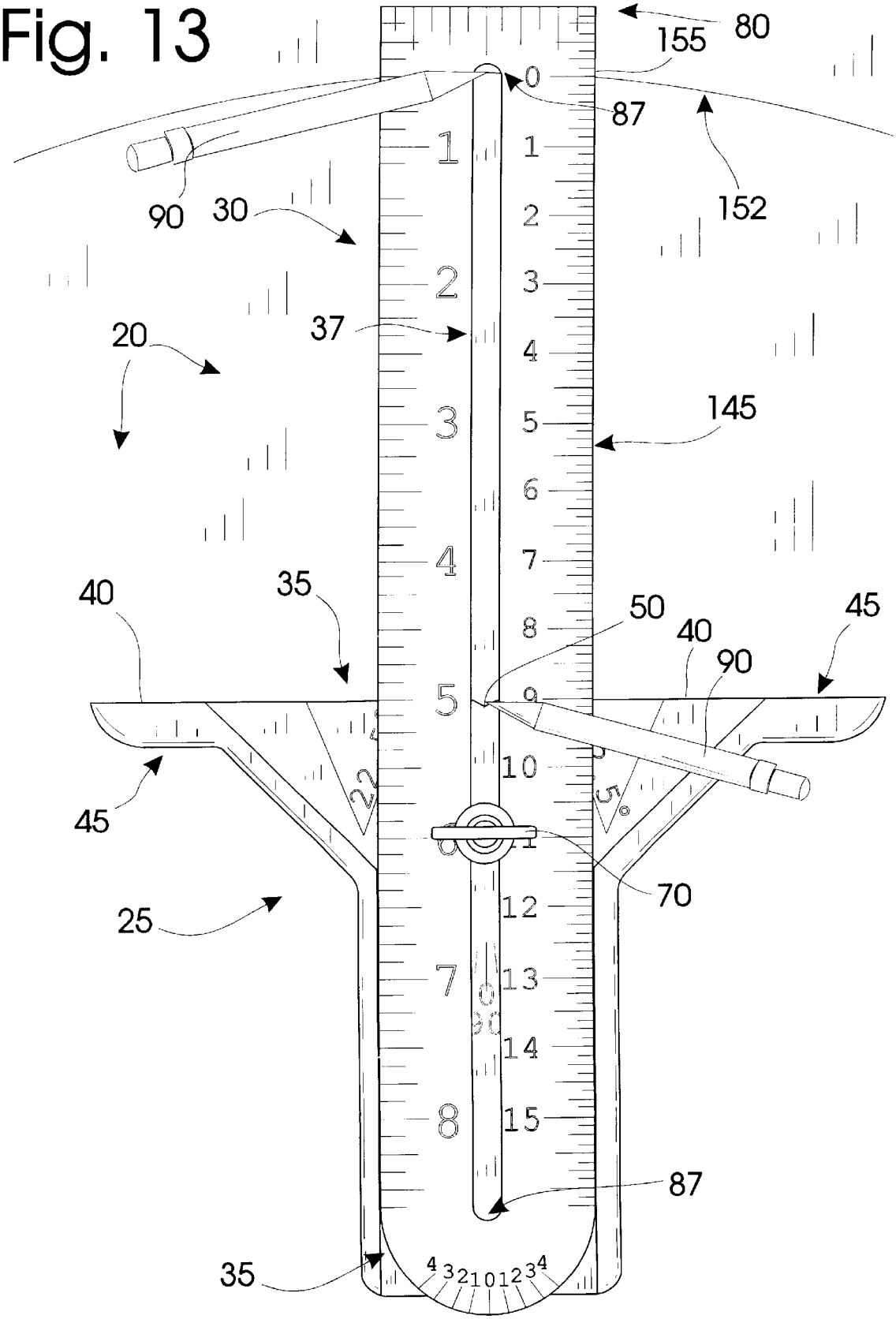
FIG. 13 is an environmental view of my tool in use as a compass.

When disposed in a square configuration the tool 20 is also useful for drawing circles or arcs 152 similar to a compass as illustrated in FIG. 13. The rule 30 is set to the desired diameter of the circle or arc 152 by aligning the desired diameter indicia 145 with the squaring edge 40 of the base 25. The tool 20 is then anchored at the distal end 87 of the rule slot 37 by inserting a pencil 90, punch or the like through the slot 37 to a center point 195 for the circle or arc 152. A marking instrument such as a pencil 90 is held tight against the V-shaped index notch 50, in contact with the workpiece surface 49 to be marked and the tool 20 is rotated about the anchor 90.

To use the tool 20 to layout angles the rule 30 must be fully extended so that the proximal rounded end 88 of the rule slot 37 rests against the shank of the thumb screw 70 or the stud, allowing the rule 30 to swing from side to side as necessary As seen in FIGS. 7 through 10. The thumb screw 70 or nut is used to lock the rule 30 in a desired angle relative to the squaring edge 40 of the base 25.

Figure 7:
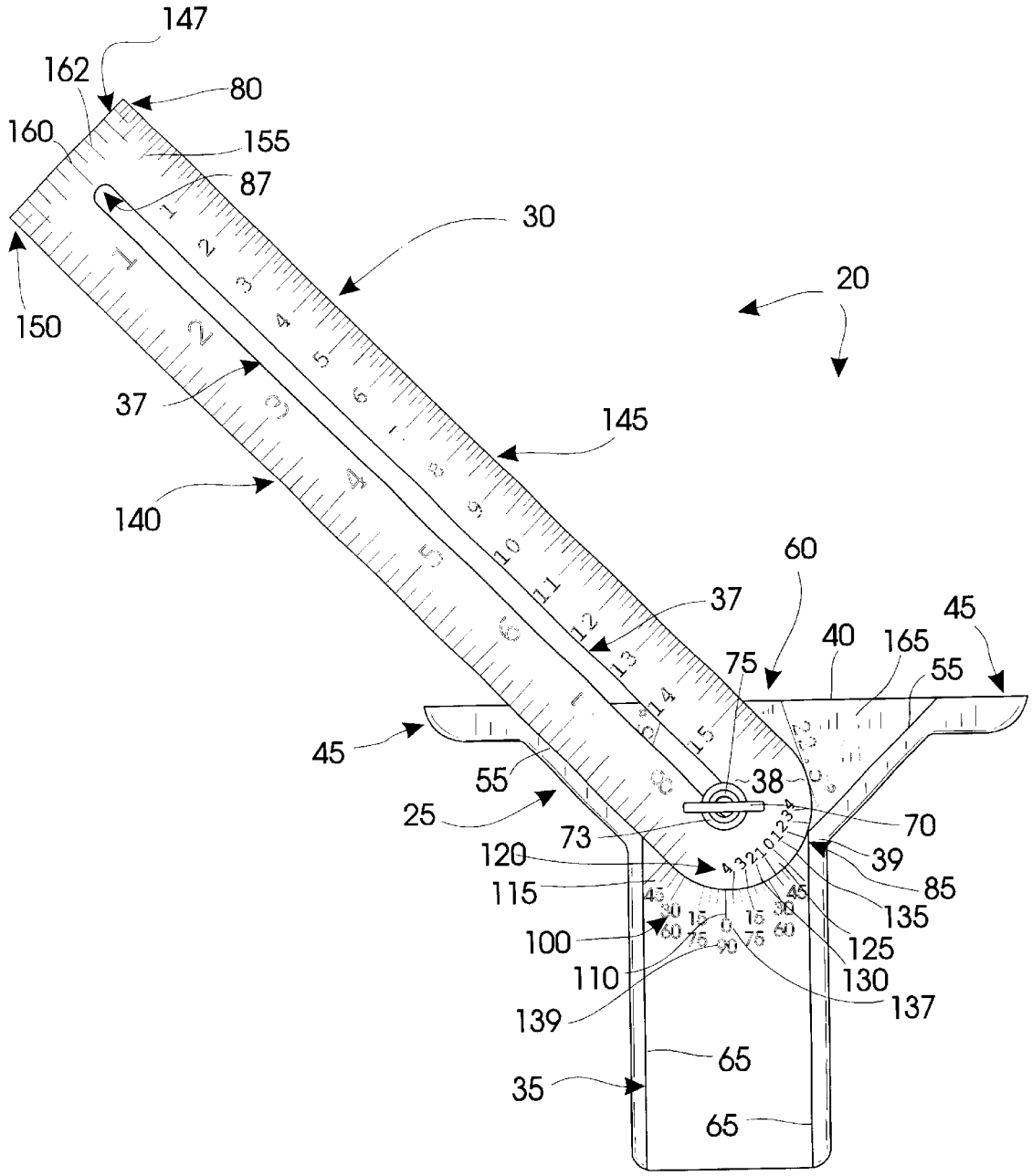
FIG. 7 is a top plan view of my tool with the rule extended and disposed at a 45° angle.

As illustrated in FIG. 7, the rule 30 can be locked with an edge contacting one of the walls 55 of the flared portion 60 of the channel 35 to dispose the rule 30 at a forty-five degree angle relative to the squaring edge 40 of the base 25. This duplicates the angled function of a combination square.

The rule 30 can also be disposed at any direct angle between zero and forty-five degrees, or in a reverse angle between forty-five and ninety. An existing angle can be duplicated by placing the squaring edge 40 against a straight edge 47 of a workpiece 49 and freeing the rule 30 to be adjusted to aligned with an exiting mark, edge 47 or other feature. The rule 30 is then locked in place by tightening the thumb screw 70 or nut. The angle can then be transferred or read using the vernier and protractor scales 120 and 100. (See FIGS. 7 through 10.)

Figure 8:
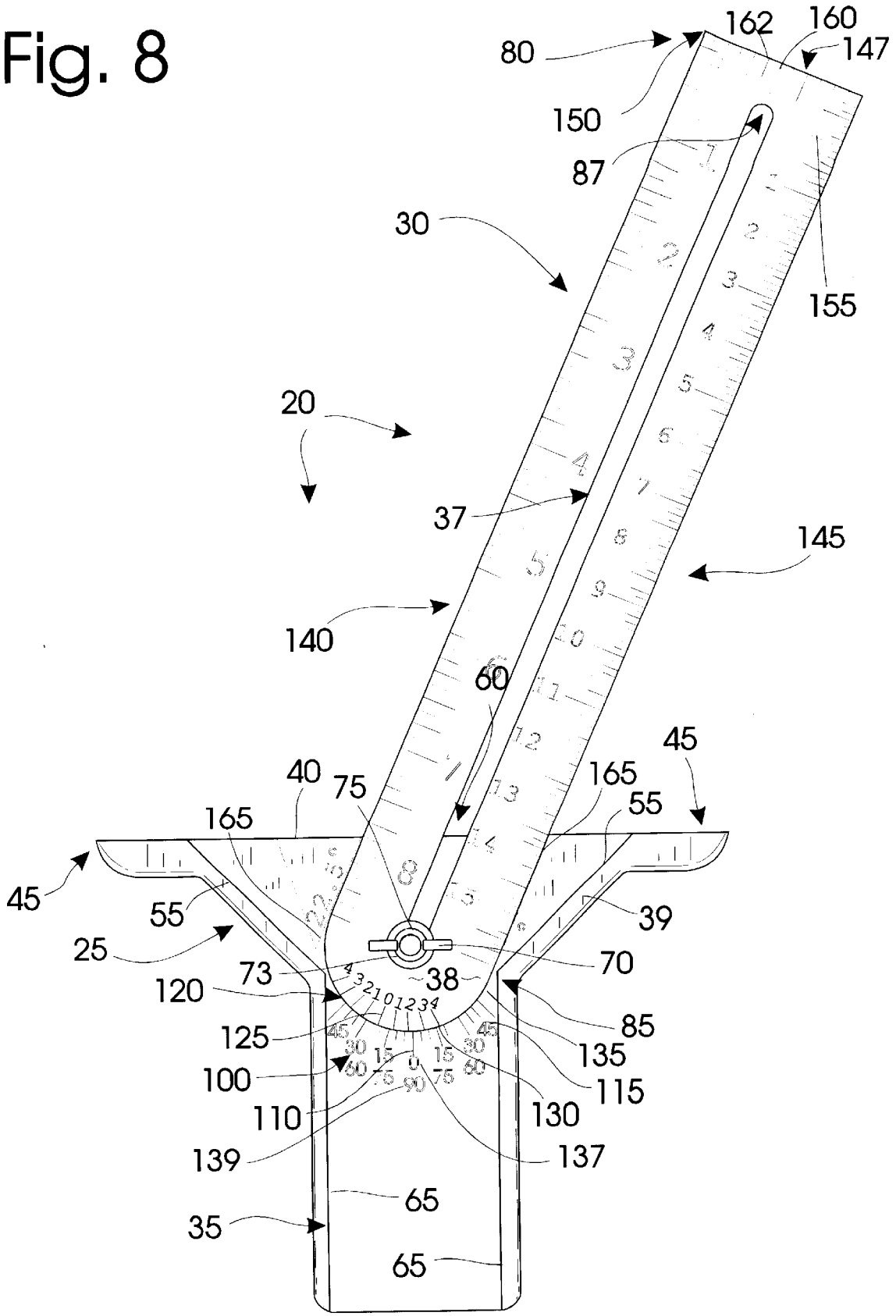
FIG. 8 is a top plan view of my tool with the rule disposed at a 22.5° and/or 67.5° angle.
Figure 9:
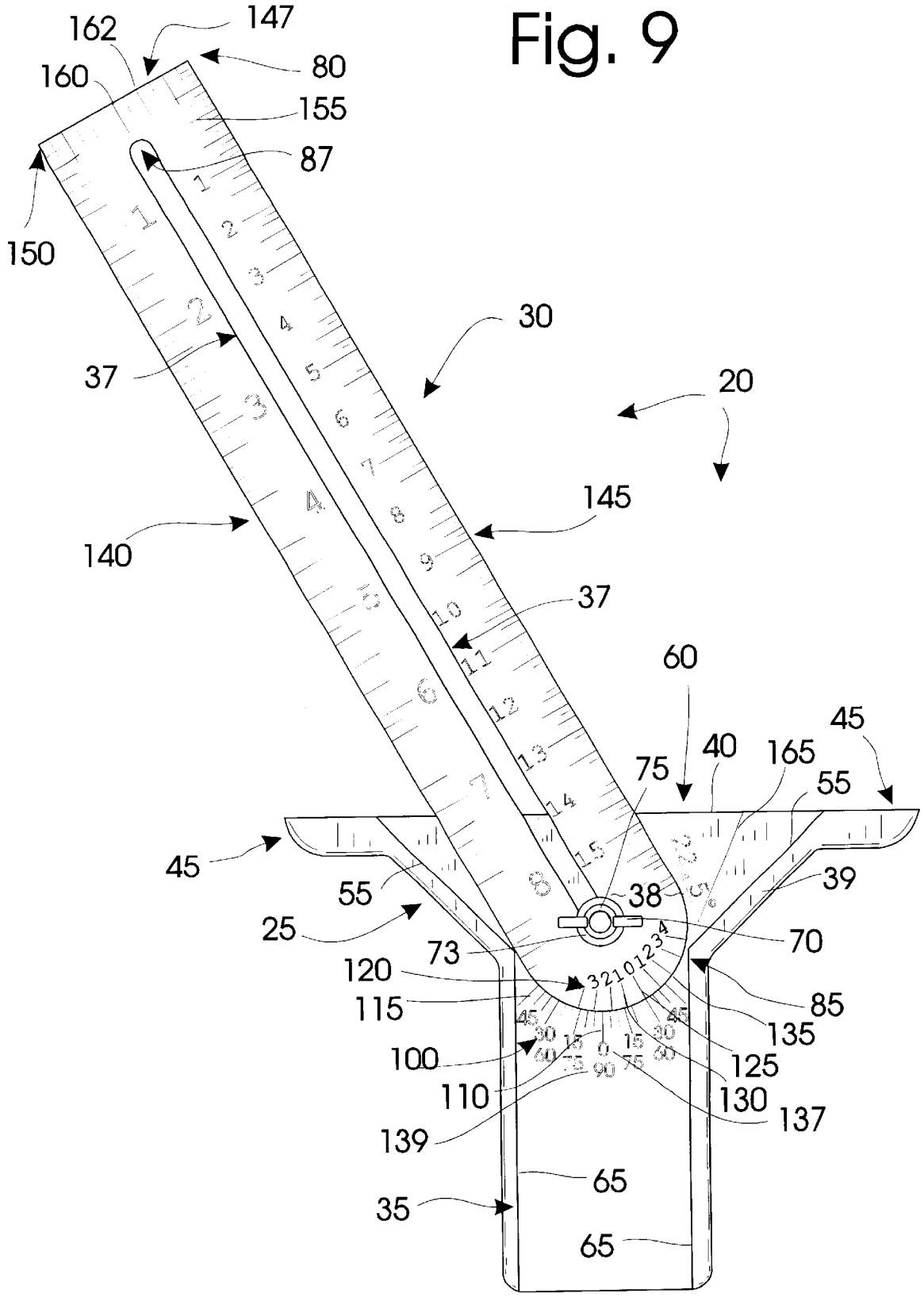
FIG. 9 is a top plan view of my tool with the rule disposed at a 30° and/or 60° angle.
Figure 10:
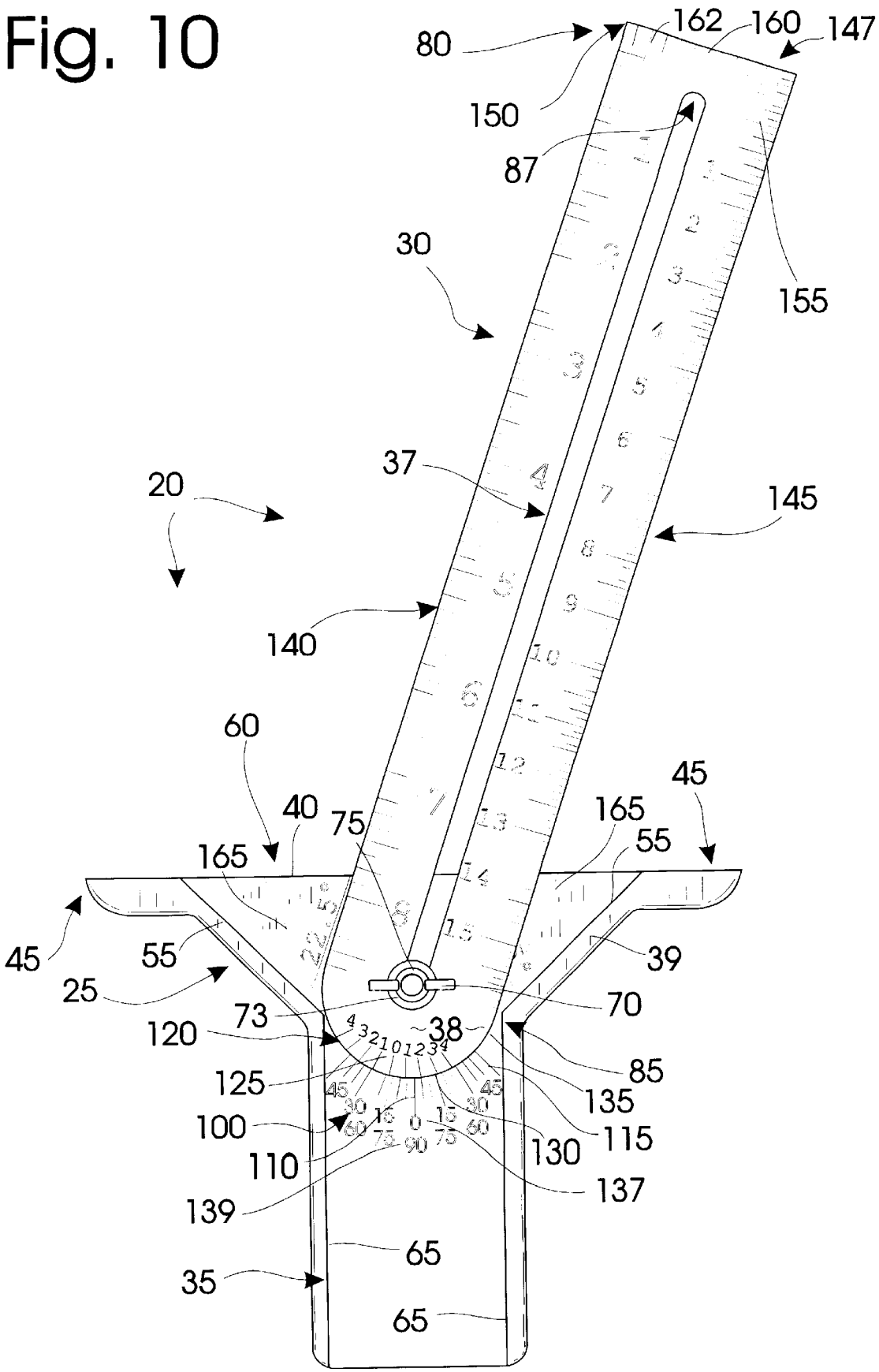
FIG. 10 is a top plan view of my tool with the rule disposed at a 17° and/or 73° angle.

For use as a protractor, to layout specific angles the vernier and protractor scales 120 and 100 are generally used. Alternatively, the predetermined angle(s) marks 165 in the flared portion 60 of the channel can be used, as illustrated in FIG. 8, if applicable. To use the predetermined angles, each edge of the rule 30 is aligned with one of the paired parallel intermediate angle lines 165 and the rule 30 locked down. The rule 30 is then disposed at the predetermined angle (or reverse angle) relative to the squaring edge 40 of the base 25.

To use the vernier and protractor scales 120 and 100 the rule 30 is disposed at an angle approximating the desired angle relative to the squaring edge 40. Then the desired protractor scale protractor indicia 137 or 139 is read while adjusting the angle of the rule 30. First, the zero of the vernier 120 is roughly aligned with the nearest, lower five degree mark on the protractor 100. Then the desired additive one degree increment between one and four on the vernier is aligned with next available mark on the protractor scale 100. See the vernier and protractor scales 120 and 100 of FIGS. 7 through 10. Similarly, the rule 30 can be aligned with an existing mark and the angle read from the vernier and protractor scales 120 and 100 using the appropriate protractor indicia 137 or 139.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense. For example, the tool 20 can be constructed out of a resilient material, a relatively rigid material or metal. However, plastic or other nonconductive materials provide certain safety advantages. Furthermore, the use of alternative units of measure for both linear and radial measurements is clearly anticipated.

What is claimed is:

1. A multifunction layout tool comprising:

a generally "T" shaped, integral squaring base, said base comprising a central body portion, said body portion defining a central longitudinal channel, said channel having a flared portion; and, a pair of squaring arms extending from a first end of said body portion, generally perpendicular to said channel and;

an elongated rule adapted to be disposed in said channel, said rule comprising a blade defining a central slot; and, fastener means for adjustably securing said rule in said channel of said body portion of said base.

2. The tool as defined in claim 1 wherein said channel further comprises a parallel portion, said parallel portion disposed generally perpendicular to said squaring arms and said flared portion disposed adjacent said squaring arms.

3. The tool as defined in claim 2 wherein said blade of said rule comprises a first end disposed generally perpendicular to said slot and a rounded second end, said second end disposed within said channel and said first end extending from said tool, between said squaring arms.

4. The tool as defined in claim 3 wherein said rule pivots about said fastener means when said rule is fully extended.

5. The tool as defined in claim 4 wherein said rule further comprises measurement indicia.

6. The tool as defined in claim 5 wherein said base further comprises protractor indicia disposed within said channel about said fastener means for measuring disposition angles of said rule in conjunction with vernier indicia disposed on said second end of said rule blade.

7. The tool as defined in claim 6 wherein said measurement indicia includes direct measurement indicia initiating from said first end of said blade.

8. The tool as defined in claim 7 wherein said measurement indicia includes radius measurement indicia from an edge of said base extending between said squaring arms.

9. The tool as defined in claim 8 wherein said base further comprises intermediate angle indicia disposed within said flared portion of said channel indicating specific intermediate disposition angles of said rule, said intermediate angle indicia comprising paired parallel lines selectively alignable with opposite edges of said rule for disposition of said rule at a predetermined angle relative to said edge of said base.

10. The tool as defined in claim 9 further comprising level means for plumbing a workpiece abutting said edge of said base.

11. The tool as defined in claim 10 wherein said fastener means comprises a threaded orifice defined in said body and a thumb screw extending through said slot in said rule.

12. The tool as defined in claim 10 wherein said fastener means comprises a threaded stud extending from said channel through said slot in said rule and a threaded nut disposed on said stud.

13. A multifunction layout tool comprising:

a generally "T" shaped, integral squaring base, said base comprising:

a body portion defining a central, open topped longitudinal channel, said channel comprising a pair of spaced apart side walls, a first portion of said side walls disposed generally parallel to one another and a second portion of said side walls disposed generally perpendicular to each other, defining a flared portion in said channel; and, a pair of squaring arms extending generally perpendicularly from a first end of said body portion, said squaring arms and a first end edge of said base defining a squaring edge along said first end of said base, generally perpendicular to said channel;

protractor indicia disposed within said channel;

an elongated rule adapted to be disposed in and extend out of said channel, between said squaring arms, said rule comprising:

a rounded end blade defining a central slot; and, vernier indicia disposed on said rounded end of said blade for measuring disposition angles of said rule, in conjunction with said protractor indicia disposed within said channel; and, fastener means for adjustably securing said rule in said channel, said fastener means disposed in said flared portion of said channel adjacent a first portion of said channel defined by said first, parallel portion of said side walls.

14. The tool as defined in claim 13 wherein said rule pivots about said fastener means when said rule is fully extended.

15. The tool as defined in claim 14 wherein said rule further comprises measurement indicia along said blade initiating from a square end of said blade, opposite said rounded end, said indicia comprising:

direct measurement indicia initiating from said square end; and, radius measurement indicia for drawing a circle of a given radius measured from said squaring edge of said base.

16. The tool as defined in claim 15 wherein said base further comprises intermediate angle indicia disposed within said flared portion of said channel, said intermediate angle indicia comprising paired parallel lines selectively alignable with opposite edges of said rule for disposition of said rule at a predetermined angle relative to said squaring edge of said base.

17. The tool as defined in claim 16 further comprising level means for plumbing a workpiece abutting said squaring edge of said base.

18. The tool as defined in claim 16 wherein said fastener means comprises a threaded orifice defined in said body and a thumb screw extending through said slot in said rule.

19. The tool as defined in claim 16 wherein said fastener means comprises a threaded stud extending from said channel through said slot in said rule and a threaded nut disposed on said stud.

20. A multifunction layout tool comprising:

a generally "T" shaped, integral squaring base, said base comprising:

a body portion defining a central, open topped longitudinal channel, said channel comprising a pair of spaced apart side walls, a first portion of said side walls disposed generally parallel to one another, defining a first portion of said channel; and a second portion of said side walls disposed generally perpendicular to each other, defining a flared portion of said channel; and, a pair of squaring arms extending generally perpendicularly from a first end of said body portion, said squaring arms and a first end edge of said base defining a squaring edge along said first end of said base, generally perpendicular to said channel;

a threaded orifice defined in said flared portion of said channel, adjacent said first portion of said channel; and, indicia disposed within said channel said indicia comprising:

protractor indicia disposed within said channel; and intermediate angle indicia disposed within said flared portion of said channel, said intermediate angle indicia comprising paired parallel lines disposed at a predetermined angle;

an elongated rule adapted to be disposed in and extend out of said channel, between said squaring arms, said rule comprising:

a blade having a rounded end, a square end, and a central slot;

direct measurement indicia along said blade initiating from said square end of said blade;

radius measurement indicia for drawing a circle of a given radius measured from said squaring edge of said base; and, vernier indicia disposed on said rounded end of said rule blade for measuring disposition angles of said rule in conjunction with said protractor indicia disposed within said channel;

a thumb screw extending through said slot in said rule into said threaded orifice defined in said base to adjustably secure said rule in said channel and selectively allowing said rule to pivot about said thumb screw when said rule is fully extended; and, a vial level disposed in a recess defined in a back of said base, said level disposed generally parallel with said squaring edge to facilitate plumbing a workpiece abutting said squaring edge of said base.

* * * * *